US006499327B1

(12) United States Patent
Sugimoto

(10) Patent No.: US 6,499,327 B1
(45) Date of Patent: Dec. 31, 2002

(54) LOCKABLE CAP

(75) Inventor: Naoyuki Sugimoto, Tokyo (JP)

(73) Assignee: Takigen Mfg. Co., Ltd, Tokyo (JP)

( * ) Notice: Subject to any disclaimer, the term of this patent is extended or adjusted under 35 U.S.C. 154(b) by 0 days.

(21) Appl. No.: 09/628,088

(22) Filed: Jul. 28, 2000

(30) Foreign Application Priority Data

Aug. 2, 1999 (JP) ..... 11-218458

(51) Int. Cl.[7] ..... E05B 13/02; E05B 17/14

(52) U.S. Cl. ..... 70/423; 70/345; 70/387; 70/DIG. 34

(58) Field of Search ..... 70/159, 423, 424, 70/427, 428, 455, 345, 387, 405, DIG. 34; 220/210

(56) References Cited

U.S. PATENT DOCUMENTS

| | | | | | |
|---|---|---|---|---|---|
| 451,616 | A | * | 5/1891 | Egelston | 292/148 |
| 1,314,306 | A | * | 8/1919 | Cullison | 70/455 |
| 1,389,858 | A | * | 9/1921 | Campanile | 70/50 |
| 1,880,135 | A | * | 9/1932 | Heath | 292/127 |
| 1,902,456 | A | * | 3/1933 | Matthews | 70/159 |
| 3,367,156 | A | * | 2/1968 | Johnstone | 70/366 |
| 3,759,075 | A | * | 9/1973 | Lipschutz | 70/159 |
| 3,930,388 | A | * | 1/1976 | Barras | 70/159 |
| 4,426,859 | A | * | 1/1984 | Floyd | 70/18 |
| 4,544,076 | A | * | 10/1985 | Casey | 220/210 |
| 4,917,404 | A | * | 4/1990 | Pasquali et al. | 280/853 |
| 5,205,401 | A | * | 4/1993 | Weisburn et al. | 206/1.5 |
| 5,212,974 | A | * | 5/1993 | Shen | 70/352 |
| 5,243,135 | A | * | 9/1993 | Shotey | 174/67 |
| 5,346,085 | A | * | 9/1994 | Svensson et al. | 220/210 |
| 5,419,435 | A | * | 5/1995 | Perzan et al. | 206/366 |
| 5,464,109 | A | * | 11/1995 | Greenwald | 215/207 |
| 5,467,624 | A | * | 11/1995 | Myers | 70/455 |
| 5,680,782 | A | * | 10/1997 | Komatsu et al. | 70/54.1 |
| 5,871,113 | A | * | 2/1999 | Conway et al. | 220/210 |
| 6,256,194 | B1 | * | 7/2001 | Choi et al. | 361/683 |

* cited by examiner

*Primary Examiner*—Anthony Knight
*Assistant Examiner*—John B. Walsh
(74) *Attorney, Agent, or Firm*—Darby & Darby

(57) ABSTRACT

A lockable cap is disclosed which includes a base having an opening penetrating through the base plate, an openable cover pivotably mounted on the base for releasably covering the opening, an elastic member for elastically thrusting the cover in an opening direction for exposing the opening, a latch member for retaining the cover in a closed position with respect to the base against elastic thrust applied by the elastic member, a key-operated lock disposed in the base, a key-for setting and opening the key-operated lock, and a latch releasing member attached to the key-operated lock for releasing the latch member to open the cover when the key is inserted into the lock to open.

6 Claims, 13 Drawing Sheets

LOCKABLE CAP

FIELD OF THE INVENTION

The present invention relates to a lockable cap that is attached to a locking device mounted on a door plate or the like closure means, and allows setting and opening operation of the locking device when an openable cover of the cap is opened by opening a key-operated lock disposed in the cap for locking the cover.

BACKGROUND ART

Lockable caps are known as means that are attached to a locking device mounted on a door plate and allow setting and opening operation of the locking device when an openable cover of the cap is opened by opening a key-operated lock disposed in the caps for locking the cover. The lockable caps, when opened by opening the key-operated lock therein, expose an insertion opening, through which a lock operation means such as a detachable handle is inserted and rotated, to thereby lock or unlock the door.

With the conventional lockable caps of such a structure, however, the key slot of the key-operated lock extends horizontally, and the key is inserted into the key slot from the front side of the cap. This structure of the lock inevitably thickens the entire cap, and causes intrusion of water inside through the key slot, fomenting corrosion of the interior parts.

SUMMARY OF THE INVENTION

The present invention aims to solve the above problems of the conventional lockable caps. It is therefore an object of the present invention to provide a lockable cap having a reduced thickness of the entire structure including the key-operated lock.

It is another object of the present invention to provide a lockable cap that can prevent intrusion of water and dust inside.

It is yet another object of the present invention to provide the lockable cap of the above type with a simple structure at low cost.

According to the present invention, there is provided a lockable cap comprising:

- a base having an opening penetrating through said base plate,
- an openable cover pivotably mounted on said base for releasably covering said opening,
- an elastic member for elastically thrusting said cover in an opening direction for exposing said opening,
- a latch member for retaining said cover in a closed position with respect to said base against elastic thrust applied by said elastic member,
- a key-operated lock disposed in said base,
- a key for setting and opening said key-operated lock, and
- a latch releasing member attached to said key-operated lock for releasing said latch member to open said cover when said key is inserted into said lock to open.

According to this structure, insertion of the key into the key-operated lock causes the latch releasing member to advance with the key, which advancement in turn presses the latch member toward latch releasing direction to disengage the latch member from the openable cover, allowing the cover to open.

Then the elastic thrust of the elastic member assists in pivotally displacing the cover away from the base to expose the opening, thereby allowing insertion of a lock operation means through the opening for operating the locking device placed on the rear side of the cap to lock or unlock the door. The key may be drawn out of the lock when the key-operated lock is opened, and the latch member as well as the latch releasing member automatically returns to its initial position.

After the setting or opening of the locking device is completed, the lock operation means is drawn out of the opening. The openable cover is manually rotated for closing the opening, and pressed further downward against the thrust of the elastic member. The openable cover is then held in a closed state by the latch member, which state is kept even after the manual pressing is removed.

The lock operation means may be a conventional detachable handle having a boss or a recess of a variety of shapes including triangular, rectangular, or polygonal shape, and adapted to be inserted into an operation slot or fitted on an operation shaft of a locking device.

The elastic member may be an elastic seal in the form of a ring or plate capable of covering the free end or the entirety of the opening. The elastic member provides water-tight seal at the opening when the openable cover is closed, and elastic thrust for assisting in opening the openable cover, when the latch member is released, to the extent that the latch cannot re-engage with the cover.

The key-operated lock may be a lock of a key-insertion type containing pins or a corrugated plate. By structuring the lock to have the key inserted upwards from below the lock, the entire cap may be made thinner and intrusion of water and dust may be prevented.

Further, by providing in the key insertion port a shutter that can be opened upon insertion and draw of the key, the intrusion of water and dust through the key insertion port may be prevented more effectively.

DETAILED DESCRIPTION OF PREFERRED EMBODIMENTS

Preferred embodiment of the present invention will now be described in detail with reference to the attached drawings.

FIGS. 1 to 5 illustrate one embodiment of the lockable cap in accordance with one aspect of the present invention. The lockable cap is used as a cap for a locking device that is operated with a detachable operation handle and is mounted on a closure means such as a door plate of a container shelter. For installation, the lockable cap is attached with respect to the locking device to cover at least a part of the front face of the locking device.

Figure 3:
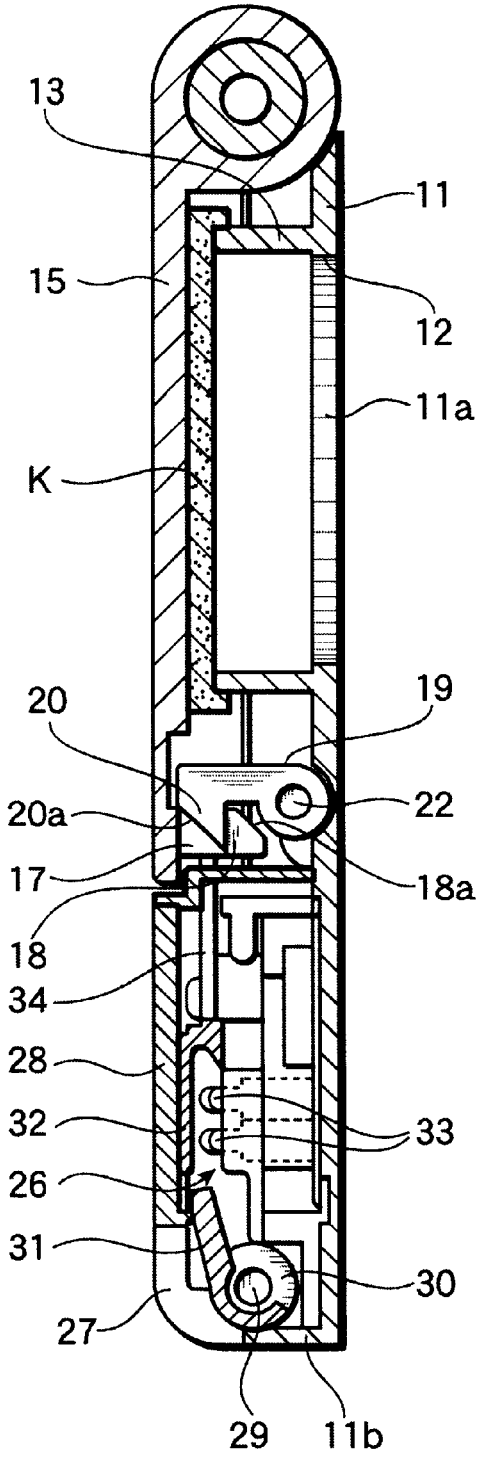
FIG. 3 is a longitudinal cross sectional view of the lockable cap of FIG. 1.
Figure 4:
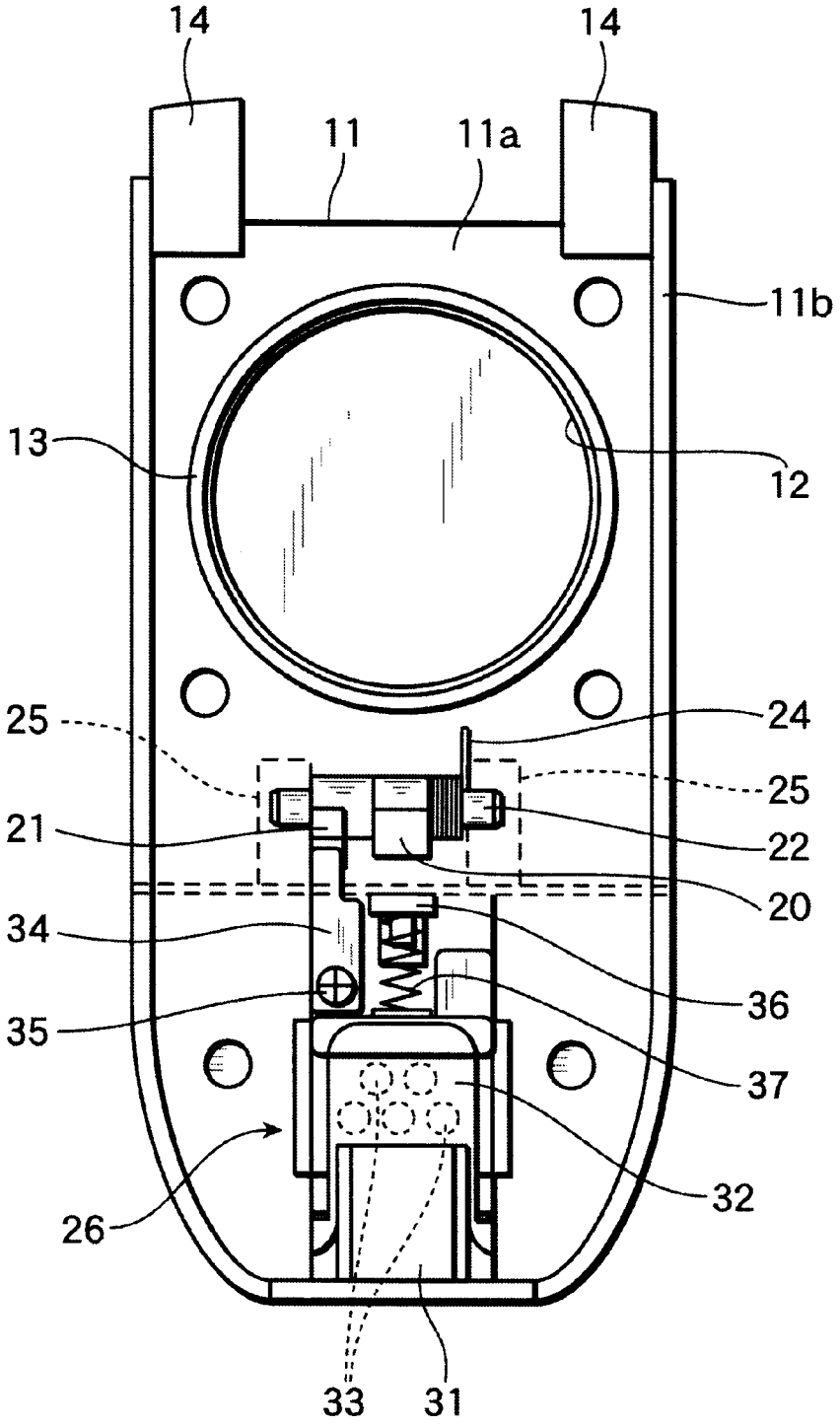
FIG. 4 is a front view of the lockable cap of FIG. 1 with the openable cover and fixed cover removed.

The lockable cap includes a base 11. As shown in FIGS. 3 and 4, the base 11 has a generally flat plate 11*a* smoothly tapered in its lower end portion and an uprising rim 11*b* extending contiguously along the left side, lower side, and right side of the plate 11*a*.

In the middle of the upper portion of the plate 11*a* is provided an opening 12 penetrating through the plate 11*a*. The opening 12 is defined by a cylindrical member 13 which slightly projects from the plate 11*a*. The height of the cylindrical member 13, i.e. the height of the member 13 from the surface of the flat plate 11*a* may be, for example, not higher than 10 mm, with the free end of the cylindrical member 13 being smoothed. When the lockable cap is mounted with respect to a locking device, the opening 12 registers with a portion of the device which receives the detachable operation handle, so that the handle may be inserted into that portion of the device through the opening 12 of the lockable cap.

An openable cover 15 having a bracket 16 at the upper end thereof is pivotably mounted on the base 11 to cover the upper portion of the base 11, with the bracket 16 being pivotably supported via a pivot axis (not shown) between a pair of brackets 14 that are integrally formed at the upper end of the flat plate 11*a* of the base 11. In the brackets 14 and 16, click members (not shown) of a conventional type are accommodated for retaining the openable cover 15 at a predetermined angular position, for example at 180°, with respect to the base 11. The click members may be of a conventional design that include an annular member having notches of a triangular cross section and an annular member having a projection of a triangular cross section being thrusted against the first annular member.

Referring to FIG. 3, the openable cover 15 is provided on its inner face with a disk-shaped elastic member K, which is positioned so as to face to and register with the cylindrical member 13 when the cover 15 is closed with respect to the base 11. The elastic member K functions as a seal for closing the free end of the cylindrical member 13 in an air- and water-tight manner in cooperation with the openable cover 15. The elastic member K also promotes, with its elastic thrust, initial opening action of the cover 15 upon release of a latch as will be described later.

The openable cover 15 is also provided with an engagement projection 18 on its inner face near its free end. The projection 18 has a sloped surface 18*a* in its tip portion, and an engagement aperture 17 penetrating the projection 18 in a generally parallel direction to the cover 15. The engagement aperture 17 detachably receives a claw 20 of a latch member 19 as discussed below.

Figure 5:
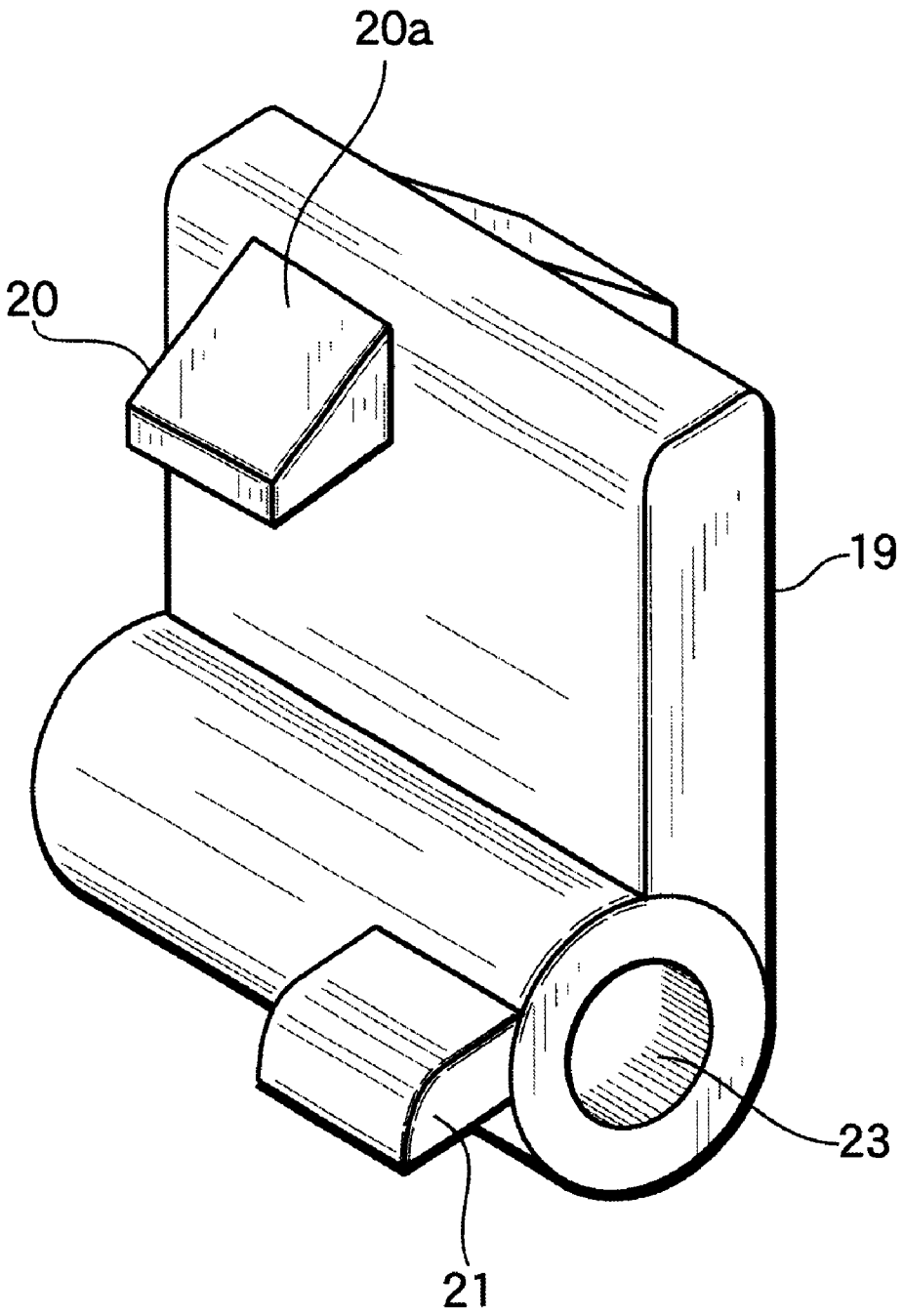
FIG. 5 is a perspective view of the latch member of the lockable cap of FIG. 1.

The latch member 19 has a general configuration as shown in FIG. 5, and is provided with a claw 20 integrally formed thereon, a projection 21 for restricting rotational movement of the latch member 19, and an axial bore 23 for receiving a horizontal axis 22 therein, on which axis the latch member 19 is rotatably supported. As shown in FIG. 4, the axis 22 is in turn supported at both ends on a pair of brackets 25 provided on the base 11, and has a spring 24 fitted therearound for rotationally thrusting the latch member 19 constantly toward the engagement of the claw 20 with the engagement aperture 17. The claw 20 has a sloped surface 20*a* for facilitating smooth slide of the claw 20 on the sloped surface 18*a* of the projection 18.

The lower portion of the base 11 is covered with a fixed cover 28 that is fixed to the base 11 with a space defined therebetween, and has a cut-out 27 at its lower end acting as a key insertion port for receiving an operation key 38 for a lock 26 to be discussed later. This cut-out 27 is openably closed from inside the cover 28 with a shutter 31, which is disposed in the cut-out 27 and rotatably supported on a horizontal shaft 29. The shaft 29 is supported at both ends by a pair of brackets 30 projecting from the base 11. The shutter 31 is constantly thrusted by a torsion spring (not shown) or the like means toward the direction for closing the cut-out 27.

Figure 1:
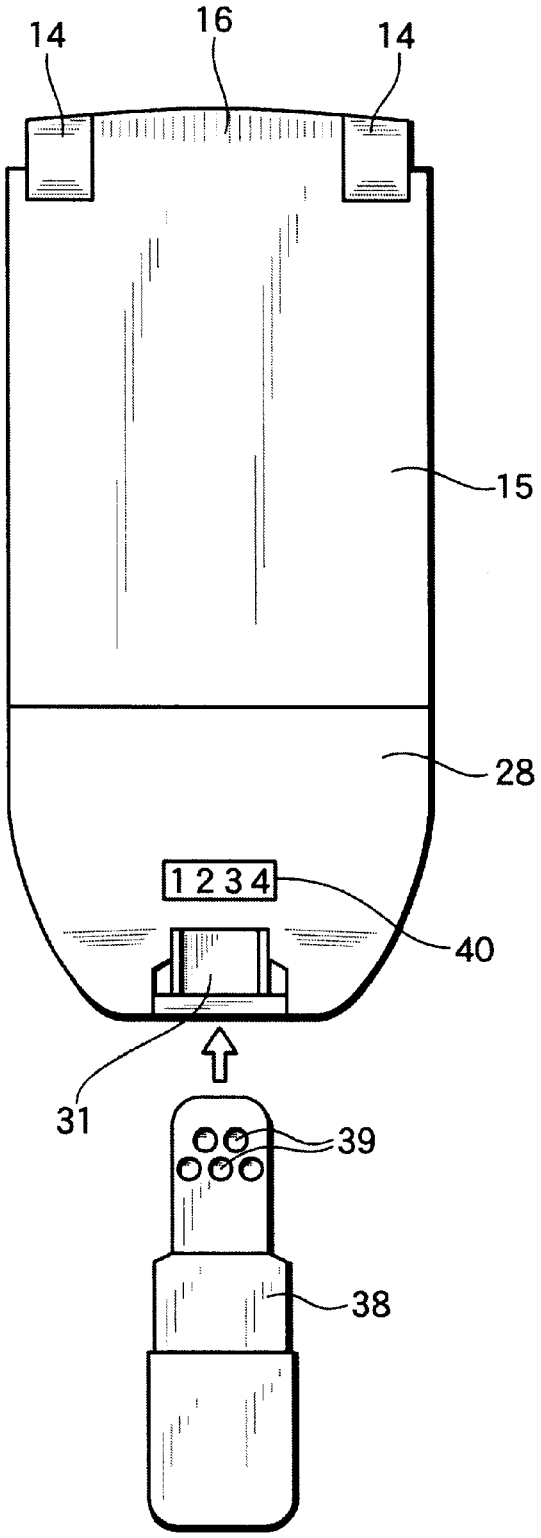
FIG. 1 is a front view of one embodiment of the lockable cap according to the present invention.
Figure 2:
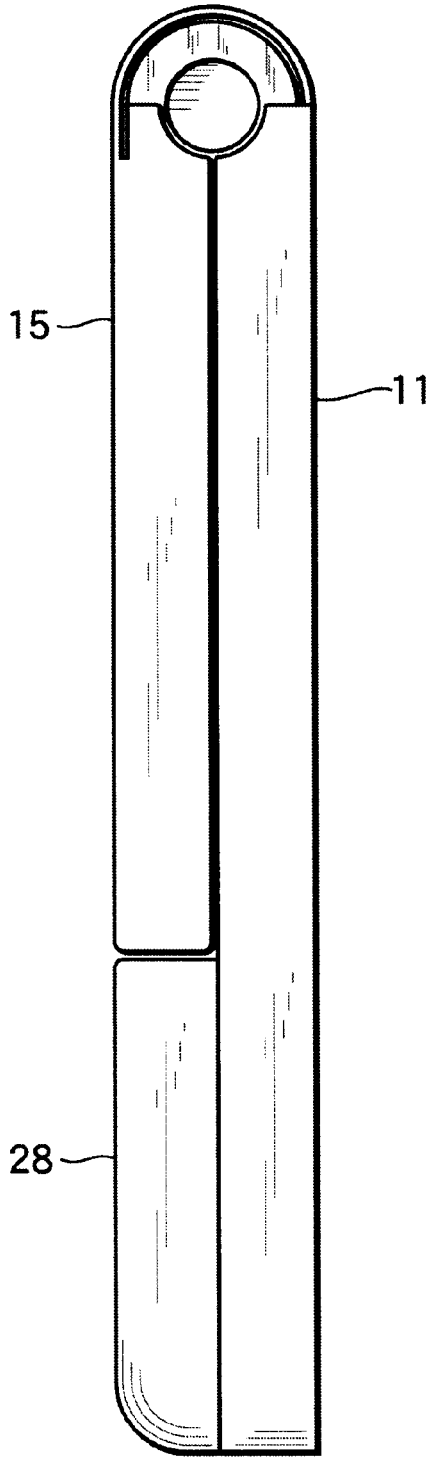
FIG. 2 is a side view of the lockable cap of FIG. 1.

In the space defined between the base 11 and the fixed cover 28, there is disposed a key-operated lock 26 on the base 11 below the latch member 19. The lock 26 is relatively thin in overall structure and may be of a conventional key-insertion type containing pins or a corrugated plate. In this embodiment, the thin lock 26 is mounted on a block (not show) thrusted by a spring, and is opened or set with an operation key 38, which is made of a metal plate of a predetermined length and has a plurality of recesses 39 provided therein (FIG. 1). On the fixed cover 28 above the cut-out 27, there is provided a number indicator 40 that indicates the number of the appropriate operation key 38 by marking or printing.

The lock 26 includes a key reception case 32 and a plurality of pins 33 for fitting in the plurality of corresponding recesses 39 in the operation key 38 when the key 38 is inserted into the case 32. To the key reception case 32 is attached a latch releasing member 34 in the form of a thin plate, with the lower end of the latch releasing member 34 fastened to the upper end of the case 32 with a screw. The upper end of the latch releasing member 34 is in contact with the latch member 19 rotatably thrusted with the torsion spring 24. The key reception case 32 is constantly thrusted downwards with a spring 37 interposed between the upper face of the case 32 and a support piece 36 projecting from the base 11.

The lockable cap of the design discussed above may be mounted facing to a locking device provided in a door plate, for example, of a container shelter for locking the shelter.

For locking or unlocking operation of the door, the operation key 38 of the number indicated on the number indicator 40 on the fixed cover 28, is first inserted upward through the cut-out 27 acting as a key insertion port, as shown in FIG. 1 by the arrow. This inwardly presses the shutter 31, which has closed the cut-out 27, to open, and the key 38 is then guided into the key reception case 32. When the key 38 reaches a predetermined location, all the pins 33 of the lock 26 fit in the corresponding recesses 39 in the key 38, allowing the key reception case 32 to advance with the key 38 in the direction of the key insertion. The key reception case 32 is displaced further upward against the resisting force of the spring 37, until the tip of the latch releasing member 34 on the upper end of the case 32 presses the latch member 19 upward against the resisting force of the torsion spring 24. This causes the latch member 19 to rotate clockwise as seen in FIG. 3 around the horizontal shaft 22, thereby releasing the claw 20 of the latch member 19 from the engagement aperture 17 in the projection 18 on the openable cover 15.

The disengagement of the latch member 19 releases the closed cover 15, and the elastic thrust of the elastic member K at the same time assists in opening the cover 15 to slightly expose the free end of the cylindrical member 13. When the insertion of the key 38 is then stopped, the key reception case 32 returns downwardly to its initial position due to the recovering force of the spring 37, and the key 38 is allowed to be drawn out of the case 32. The downward return of the case 32 releases the pressure applied to the latch member 19 by the latch releasing member 34. This allows the claw 20 of the latch member 19 to rotate into its initial position toward re-engagement with the engagement aperture 17 of the engagement projection 18, which has already been displaced away due to the opening of the openable cover 15. Thus, the claw 20 cannot re-engage with the engagement aperture 17, and the openable cover 15 may further be opened wider manually.

When the openable cover 15 is opened, the cover 15 may be maintained, for example, at 180° with respect to the base 11 by means of the click members disposed in the brackets 14 and 16. Thus the opening 12 defined by the cylindrical member 13 is exposed to allow insertion of a lock operation means such as a detachable operation handle (not shown) from the front side. The handle is then fit in the insertion opening of the locking device mounted on the door plate, and rotated to lock or unlock the door.

When the desired locking or unlocking operation is completed, the detachable handle is drawn out of the insertion opening through the opening 12, and the cover 15 is manually rotated toward closure of the opening 12 beyond the position at which the cover 15 is maintained by means of the click members. When the cover 15 is displaced further, the sloped surface 18a of the engagement projection 18 contacts with and slides on the sloped surface 20*a* provided on the claw 20 of the latch member 19, to rotatably open the latch member 19 clockwise as seen in FIG. 3, allowing the claw 20 of the latch member 19 to automatically fit in the engagement aperture 17. As a result, the cover 15 is maintained in the closed position with respect to the base 11 by the latch member 19, closing the opening 12.

In the embodiment hitherto been described, the key-operated lock 26 is opened with the particular key 38. It is understood, however, by those skilled in the art that the lock 26 cannot be opened or set with a key not matching the number and position of the pins arranged in the key reception case 32, and thus the latch releasing member 34 cannot be operated to enable opening of the cover 15.

Figure 6:
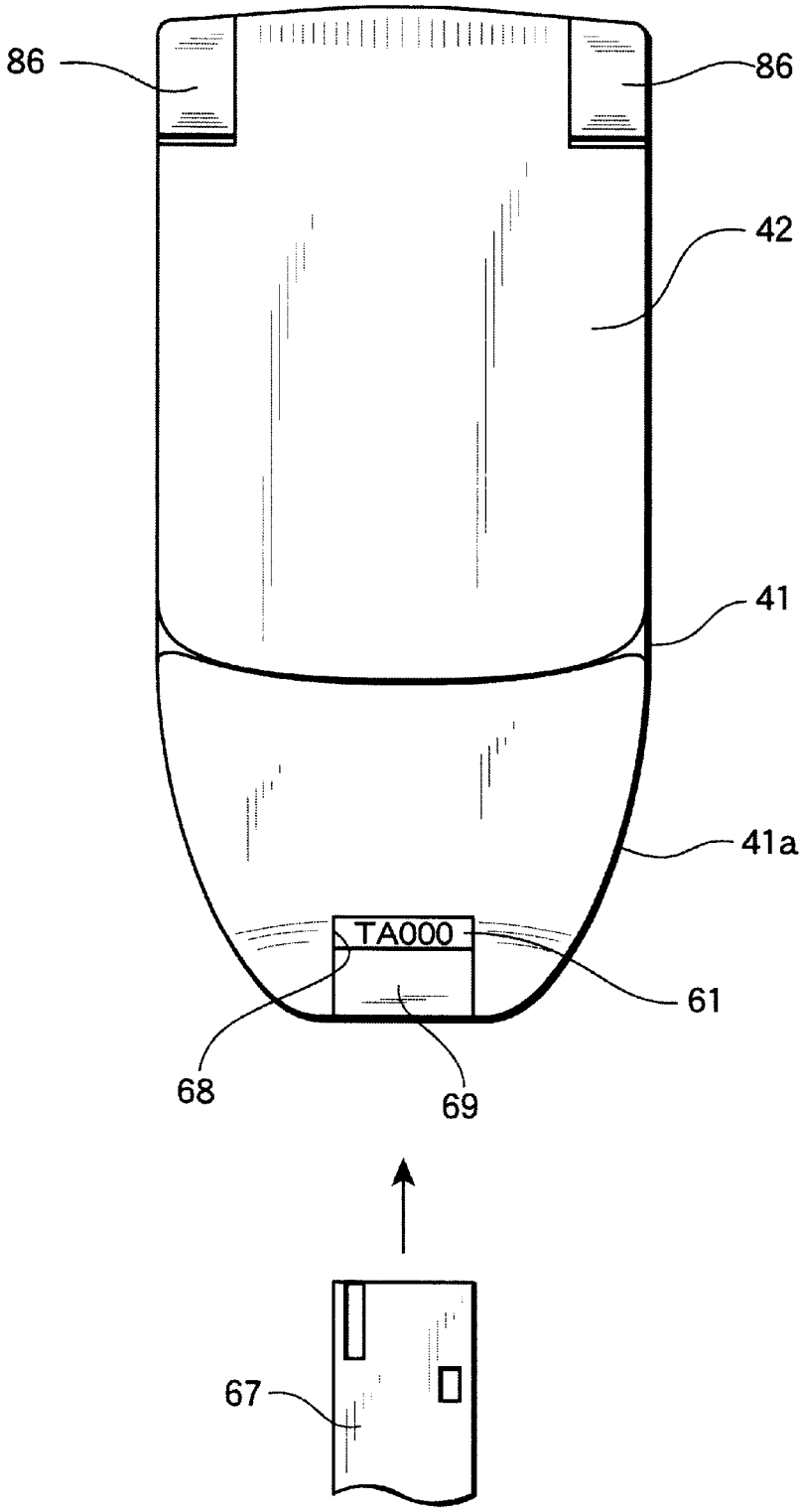
FIG. 6 is a front view of another embodiment of the lockable cap according to the present invention.
Figure 7:
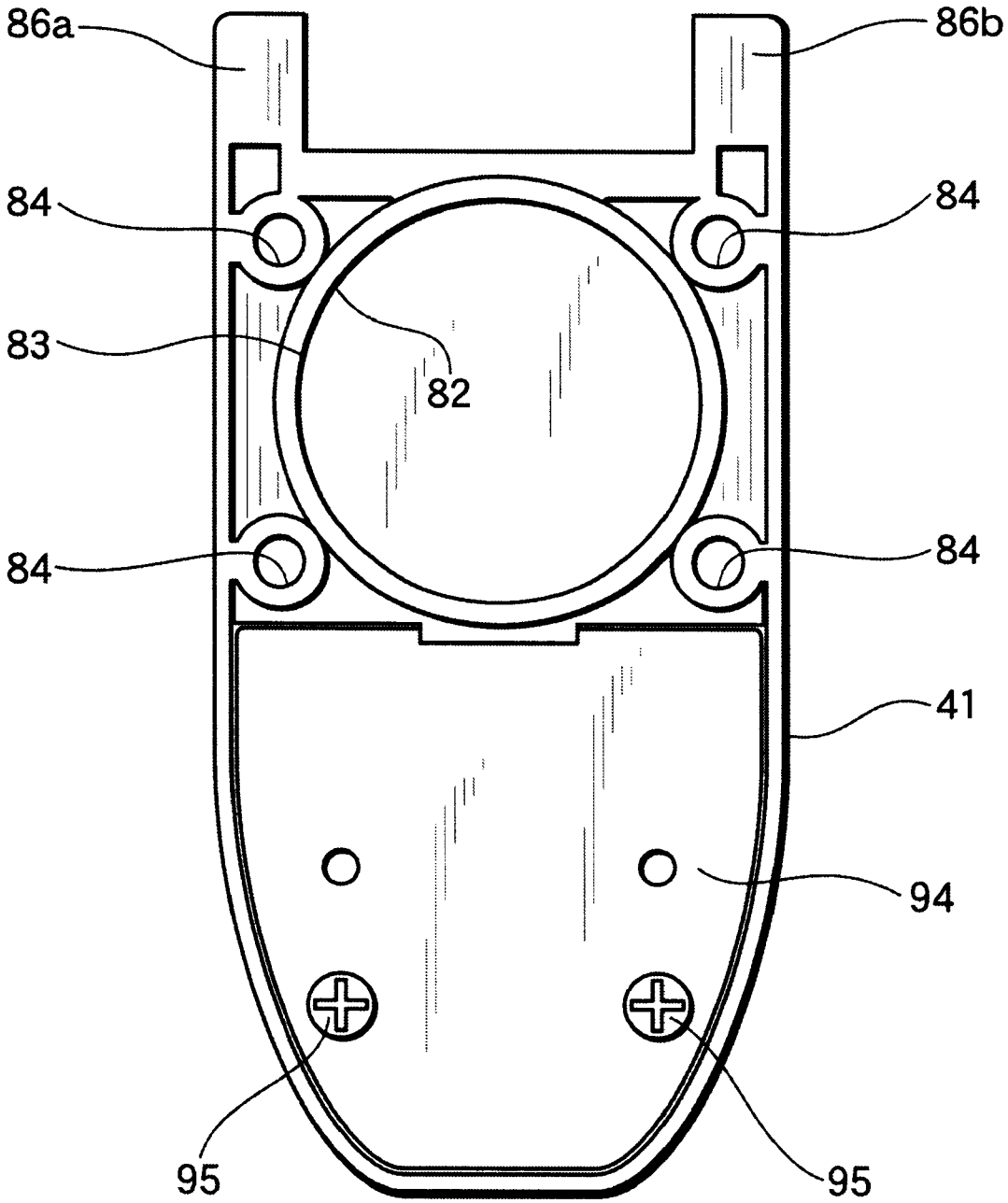
FIG. 7 is a rear view of the lockable cap of FIG. 6 with the openable cover removed.
Figure 8:
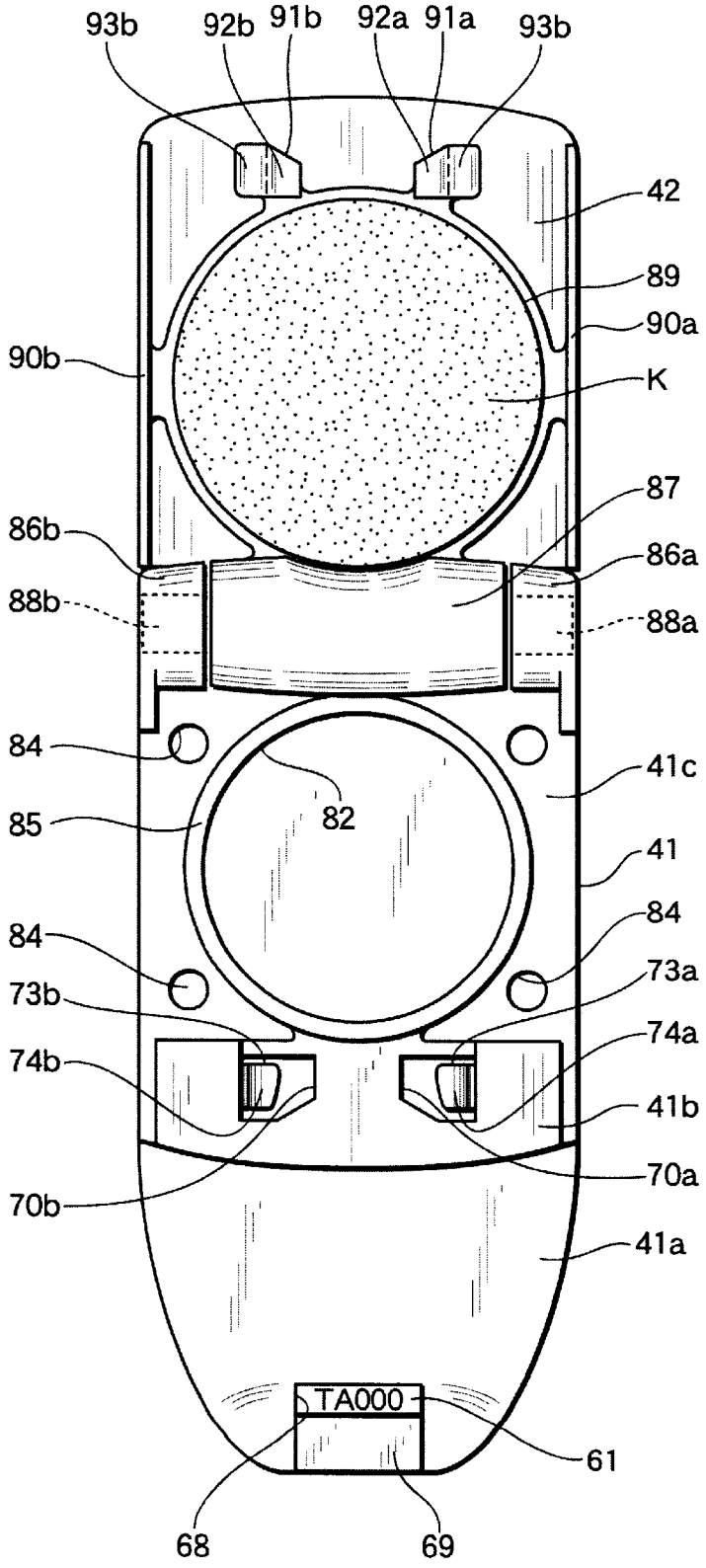
FIG. 8 is a front view of the lockable cap of FIG. 6 with the openable cover opened.
Figure 9:
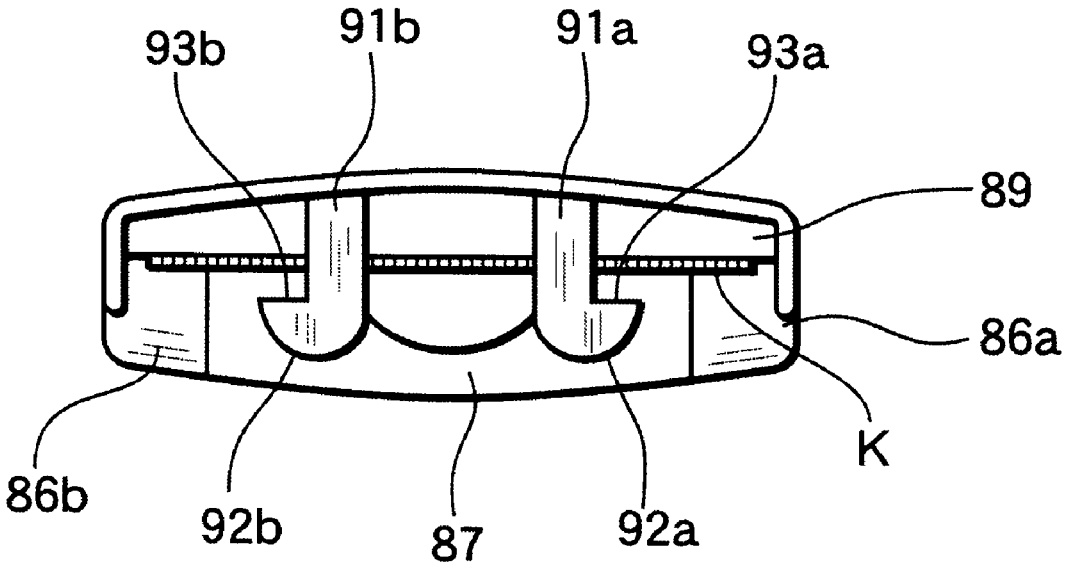
FIG. 9 is a top plan view of the lockable cap of FIG. 6 with the openable cover opened and positioned at 180° with respect to the base.
Figure 10:
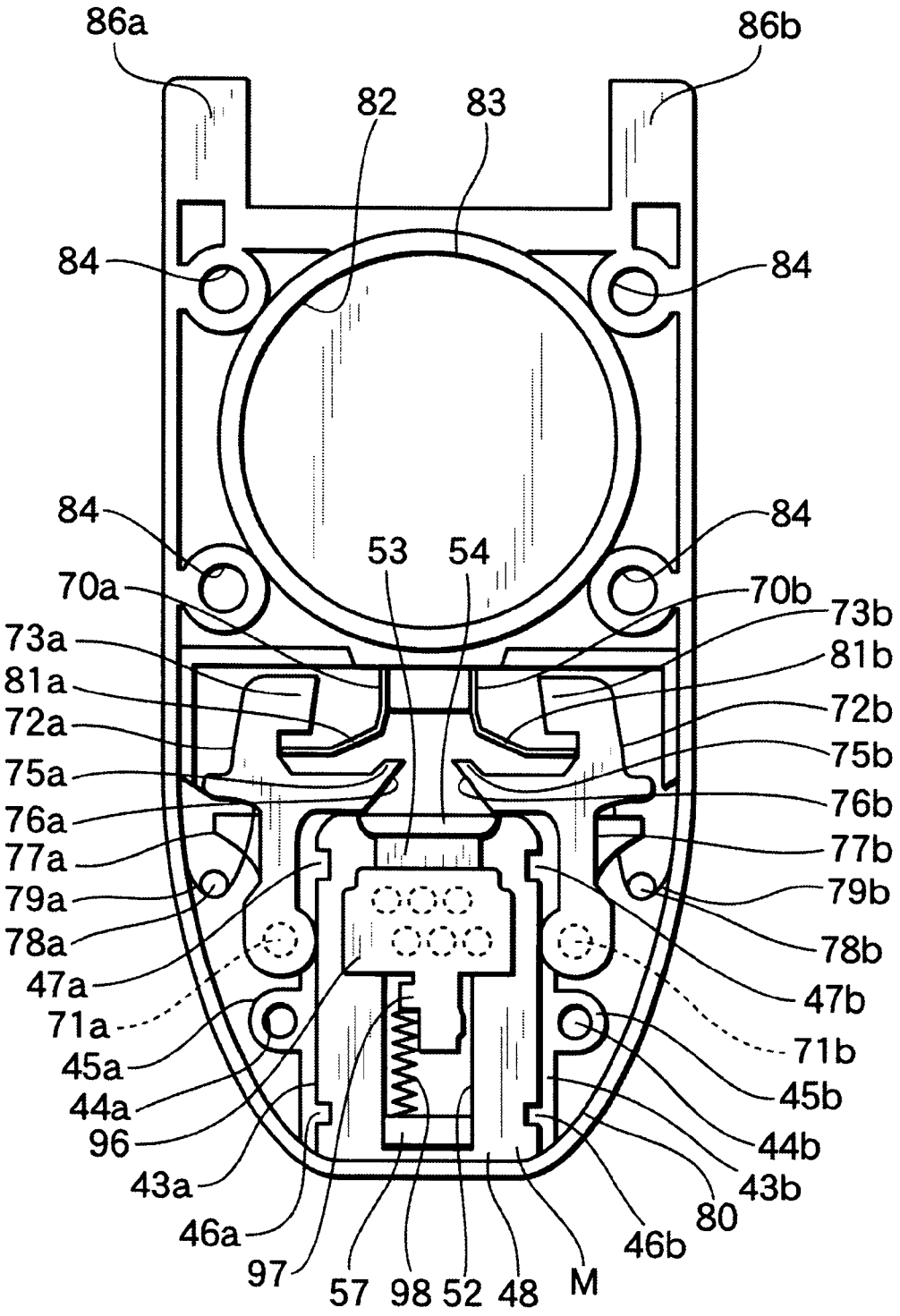
FIG. 10 is a rear view of the lockable cap of FIG. 6 with the openable cover and the back plate removed.
Figure 11:
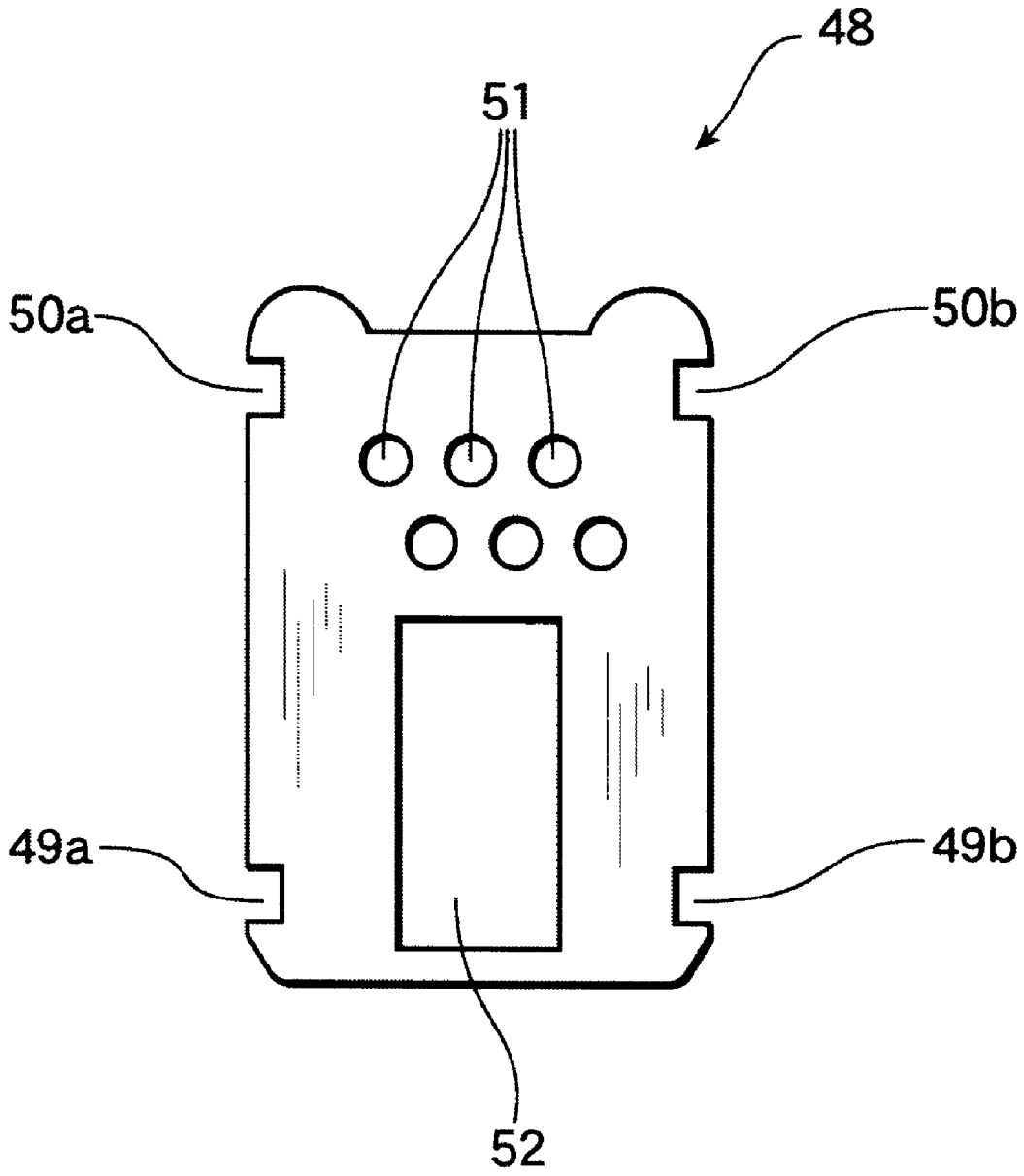
FIG. 11 is a rear view of the lock block shown in FIG. 10 with associated parts removed.

Next, another embodiment of the present invention is described with reference to FIGS. 6 to 13, wherein FIGS. 6 and 7 are front and rear views of the lockable cap of this embodiment, respectively; FIG. 8 is a front view of the cap with a cover opened; FIG. 9 is a plan view with the cover opened; and FIG. 10 is a rear view of the cap showing the detail.

Referring to FIG. 6, the lockable cap of this embodiment includes a base 41 produced, for example, by die-casting of aluminum, and an openable cover 42 produced, for example, also by die-casting of aluminum and pivotably connected to the base 41. As may be understood from FIG. 8, the base 41 has a longitudinally varying thickness or steps, namely, a thickest lock housing section 41*a* located in the lowermost portion, an openable cover engagement section 41*b* with a medium thickness located in the middle portion, and a thinnest handle receiving section 41*c* located in the uppermost portion.

Integrally formed on the back of the lock housing section 41*a* are a pair of lock supporting members 43*a*, 43*b* projecting from the base 41. Each of the lock supporting members 43*a* and 43*b* is provided with guiding protrusions 46*a*, 46*b*, 47*a*, 47*b* and a fixation tongue 45*a*, 45*b* having therein a screw hole 44*a*, 44*b*, respectively, all of which are formed integrally with the member 43*a* or 43*b*. The lock supporting members 43*a* and 43*b* support between them a lock M of a key-insertion type containing pins, which lock has a lock block 48 as shown in rear view in FIG. 11 and a key reception case 53 as shown in FIGS. 12 and 13.

The lock block 48 may be produced by die-casting of aluminum, and is of a generally rectangular shape. The block 48 has channels 49*a*, 49*b*, 50*a*, and 50*b* in its outer surface near the corners, which channels receive the guiding protrusions 46*a*, 46*b*, 47*a*, and 47*b*, respectively, to guide and place the lock M in a proper location between the lock supporting members 43*a* and 43*b*. The block 48 is also provided with a plurality of apertures 51 (six apertures in this embodiment) penetrating the block 48, in which apertures pins (not shown) are fitted to be displaced by an operation key 67 inserted into the lock M. Below the apertures 51, a longitudinally elongated opening 52 is provided for slidably receiving and guiding a part of the key reception case 53 as will be discussed later. The opening 52 also accommodates a coil spring 98 that constantly thrusts the key reception case 53 downward into the initial position.

The key reception case 53 slidably engages with the lock block 48 on the front side of the block 48 (in FIG. 10, the rear side of the lock block 48). FIG. 12 illustrates the rear side, i.e. the side in slidable contact with the lock block 48, of the key reception case 53, and FIG. 13 illustrates the front side of the case 53.

Figure 12:
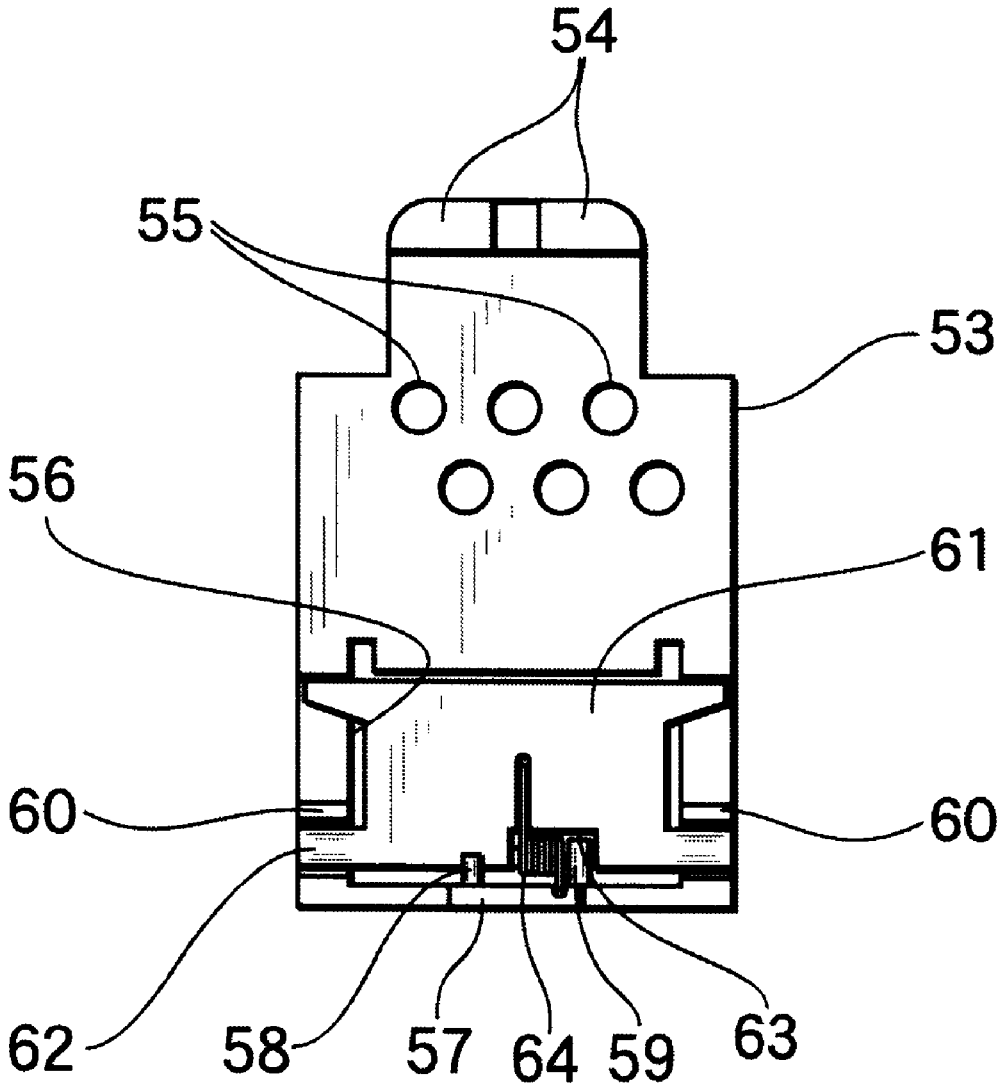
FIG. 12 is a rear view of the key reception case shown in FIG. 10.
Figure 13:
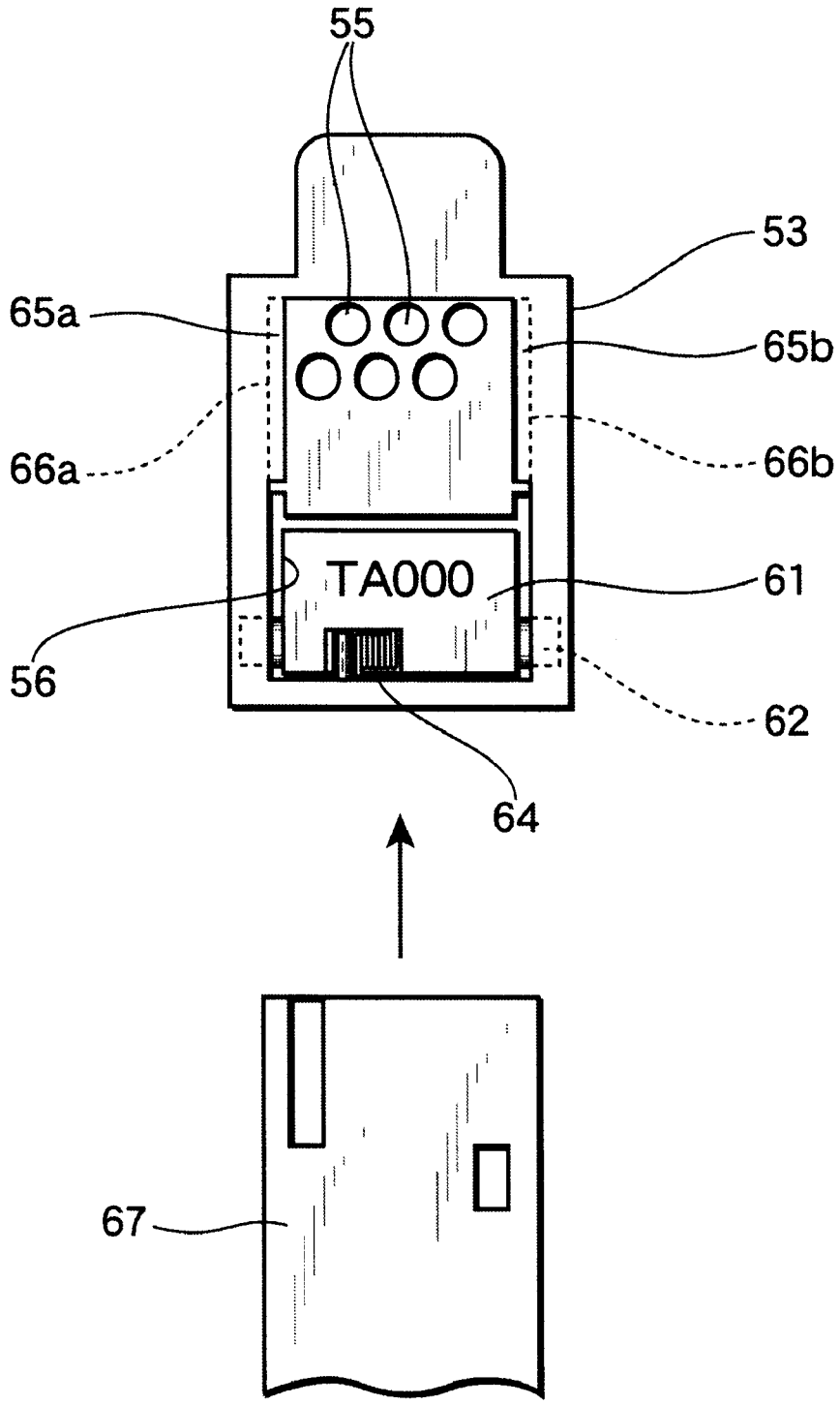
FIG. 13 is a front view of the key reception case of FIG. 12.

Referring to FIG. 12, the key reception case 53 has on its upper end a pair of latch releasing members 54 that protrude forward in FIG. 12. Below the latch releasing member 54 are provided the same number of apertures 55 as the apertures 51 in the lock block 48 at locations facing to and in registration with the apertures 51 for receiving pins and springs for thrusting these pins toward the apertures 51.

An opening 56 for receiving a shutter 61 therein as will be discussed later is formed in the lower half of the key reception case 53. At the lower end of the case 53 in the middle thereof, a spring supporting ledge 57 is provided projecting forward (as shown in FIG. 12) for supporting the spring 98 thereon. The ledge 57 has a spring engagement projection 58 formed integrally with the ledge 57 and projecting upward. Near the root of the ledge 57 is provided a spring supporting projection 59 projecting upward from the lower end of the case 53.

At the lower corners of the key reception case 53, a pair of shaft bearing protrusions 60 project forward as shown in FIG. 12 on the right and left sides of the opening 56. A shaft 62 of the shutter 61 is rotatably supported in the bearing protrusions 60, so that the shutter 61 is positioned in the opening 56 between the bearing protrusions 60 and above the spring supporting ledge 57. The shaft 62 has a cut-out 63 for receiving, in cooperation with the spring supporting projection 59, a spring 64 therein that constantly thrusts the shutter 61 in the closing direction.

Referring now to FIG. 13, from the front side of the key reception case 53 along the right and left sides thereof are projecting a pair of guiding members 65*a*, 65*b* that have an inverted L-shaped cross section and define guide channels 66*a* and 66*b*, respectively. The channels 66*a* and 66*b* smoothly guide the operation key 67 inserted into the key reception case 53 from below.

As shown in FIGS. 6 and 8, a generally rectangular cut-out 68 and a key insertion path 69 contiguous therewith are provided at the lower end of the lock housing section 41a of the base 41 for receiving the key 67. The front surface of the shutter 61 having the number of the key indicated thereon registers with the cut-out 68 and can be seen through the cut-out 68. In the openable cover engagement section 41*b*, a pair of apertures 70*a*, 70*b* are formed penetrating the base 41. A portion of latch members to be discussed later projects laterally into each of the apertures 70*a*, 70*b* and is exposed therethrough.

Referring to FIG. 10, a pair of support pins 71*a* and 71*b* are provided on the rear face of the base 41, projecting on either side of the lock M. Each of the pins 71*a* and 71*b* rotatably supports one end of a latch member 72*a*, 72*b*. The latch members 72*a* and 72*b* have latch portions 73*a* and 73*b*, respectively, projecting laterally toward each other from the other end of the latch members 72*a*, 72*b*. The latch portions 73*a* and 73*b* have sloped surfaces 74*a* and 74*b*, respectively, downwardly sloped toward each other as shown in FIG. 8.

The latch members 72*a* and 72*b* further have engagement projections 75*a* and 75*b*, respectively, projecting laterally toward each other. The free ends of the projections 75*a* and 75*b* have tapered guide surfaces 76*a* and 76*b*, respectively, slanted symmetrically from inner top toward outer bottom. The guide surfaces 76*a* and 76*b* are in contact with the upper corners of the latch releasing members 54 on the key reception case 53 as shown in FIG. 10.

Still referring to FIG. 10, the latch members 72*a* and 72*b* respectively have spring positioning portions 77*a* and 77*b* projecting laterally outwardly. In the proximity of the spring positioning portions 77*a* and 77*b*, support pins 78*a* and 78*b* project, respectively, from the rear face of the base 41, on which pins torsion springs 79*a* and 79*b* are supported in the middle portion thereof.

One end of each spring 79*a*, 79*b* abuts the latch member 72*a*, 72*b* via the spring positioning portion 77*a*, 77*b*, while the other end of the spring 79*a*, 79*b* abuts the inner surface of a plate 80 fixed on the inner periphery of the base 41. The latch members 72*a* and 72*b* are thus constantly thrusted by the springs 79*a* and 79*b* rotatably in clockwise and counterclockwise directions, respectively, around the pins 71*a*, 71*b*.

Along a portion of the periphery of the cut-out 70*a*, 70*b*, a wall 81*a*, 81*b* is formed projecting forward (in FIG. 10) from the rear face of the base 41, one end of which wall limits the rotation of the latch member 72*a*, 72*b*.

The handle receiving section 41*c* has a large opening 82 penetrating the base 41 for allowing insertion of a detachable handle. The periphery of the opening 82 is defined by a cylindrical member 83 projecting rearward from the rear face of the base 41 for a predetermined height, and a cylindrical member 85 projecting forward from the front face of the base 41 for a predetermined height, both members 83 and 85 being formed integrally with the base 41. Around the cylindrical member 83, four apertures 84 are provided for fixing a base packing (not shown) on the rear face of the base 41.

As shown in FIG. 8, the base 41 has at its upper end a pair of brackets 86*a* and 86*b*, between which a bracket 87 formed at one end of the openable cover 42 is rotatably supported via shafts 88*a* and 88*b* projecting from either side of the bracket 87. In the brackets 86*a*, 86*b*, and 87, click members (not shown) are disposed for retaining the cover 42 at a predetermined angle with respect to the base 41.

A cylindrical member 89 having a larger diameter than the cylindrical member 85 projects from the inner surface of the openable cover 42. In the cylindrical member 89, an elastic member K is fitted as a seal with a height (thickness) higher than that of the cylindrical member 89. The cylindrical member 89 is arranged symmetrically to the cylindrical member 85 with respect to the central axis of the bracket 87. A pair of side walls 90*a* and 90*b* project from the inner surface of the cover 42. Also projecting from the inner surface of the cover 42 are a pair of generally L-shaped projections 91*a* and 91*b* located near the free end of the cover 42. The projections 91*a* and 91*b* have curved end surfaces 92*a* and 92*b*, respectively, and flat engagement surfaces 93*a* and 93*b*, respectively, located opposite to the curved surfaces 92*a* and 92*b* and extending laterally outwards.

The rear faces of the lock housing section 41*a* and the openable cover engagement section 41*b* are covered with a back plate 94 as shown in FIG. 7, which plate 94 is fixed to the base 41 with screws 95 screwed into the screw holes 44*a* and 44*b*.

As shown in FIG. 10, a spring presser plate 96 is fitted on the lock block 48 to cover a portion of the block 48, and supports the coil springs accommodated in the apertures 51 with the pins. The presser plate 96 has a spring engagement portion 97 projecting laterally from the lower portion of the plate 96. The coil spring 98 is supported between the spring engagement portion 97 and the spring supporting ledge 57 of the key reception case 53. The spring 98 thus thrusts the key reception case 53 constantly downward with respect to the lock block 48.

Next, operation of the lockable cap as hitherto been discussed is described below. The lockable cap is attached with respect to a locking device mounted on a door plate, with the openable cap 42 closed as shown in FIG. 6. For locking or unlocking the door, the key 67 of the number indicated on the shutter 61 is inserted into the key insertion path 69 and advanced upwards. This opens the shutter 61, which has closed the opening 56, and the tip of the key 67 is guided along the guide channels 66*a* and 66*b* into the key reception case 53.

At a predetermined key position, tips of the plurality of pins (not shown) projecting through the apertures 55 of the case 53 fit in a slot provided on the key 67.

With the pins fitted in the slot, the key reception case 53 is advanced upwards against the thrusting force of the spring 98 as the key 67 is inserted deeper, which causes the latch releasing members 54 on the case 53 to press on the tapered guide surfaces 76*a* and 76*b* of the latch members 73*a* and 73*b*. The latch members 73*a* and 73*b* thus rotate in opposite directions around the pins 71*a* and 71*b* against the force of the torsion springs 79*a* and 79*b*. This rotation of the latch members 72*a* and 72*b* displaces the latch portions 73*a* and 73*b* laterally outwards away from each other to be disengaged from the engagement surfaces 93*a* and 93*b* of the projections 91*a* and 91*b* on the closed cover 42.

As a result, the openable cover 42 is freed to rotate around the shafts 88*a* and 88*b*, and opened instantaneously to expose the opening 82 at least partially, due to the elastic thrust of the elastic member K pressing the cylindrical member 85. When the insertion of the key 67 is then stopped, the latch members 72*a* and 72*b* rotate toward each other due to the thrust of the torsion springs 79*a* and 79*b*, and the tapered guide surfaces 76*a* and 76*b* of the latch members 72*a* and 72*b* in contact with the latch releasing members 54 press the members 54 downward into its initial position. At the same time, the key reception case 53 is pressed downward with respect to the lock block 48 due to the thrust of the spring 98, until the spring supporting ledge 57 contacts the lower surface of the opening 52 and stops. In this state, the key 67 may be drawn out of the key reception case 53.

When the openable cover 42 is released through the above operation, the cover 42 may be held, for example, at 180° with respect to the base 41 by means of the click members (not shown) provided in the brackets 87, 86*a*, and 86*b*. Thus, a lock operation means such as a detachable handle may be inserted through the opening 82 from the front side of the lockable cap, fitted in the insertion opening of the locking device mounted on the door plate, and rotated to lock or unlock the door.

When the door is locked or unlocked as desired, the detachable handle is drawn out through the opening 82, and the cover 42 in the state as shown in FIG. 8 is manually closed by rotating the cover 42 around the shafts 88*a* and 88*b* beyond the position at which the cover 42 has been held with the click members, into the state as shown in FIG. 6. In the rotation of the cover 42, the curved surfaces 92*a* and 92*b* of the projections 91*a* and 91*b* shown in FIG. 9 slidably contact with the sloped surfaces 74*a* and 74*b* of the latch portions 73*a* and 73*b* to press the latch portions 73*a* and 73*b* away from each other. This causes counterclockwise and clockwise rotation of the latch members 72*a* and 72*b* (in FIG. 10) away from each other, respectively, around the support pins 71*a* and 71*b*, thereby displacing the latch members 72*a* and 72*b* to open.

When the latch portions 73*a* and 73*b* are displaced to their outermost positions through the slidable contact with the curved surfaces 92*a* and 92*b*, the portions 73*a* and 73*b* then snap-fit with the engagement surfaces 93*a* and 93*b* due to the thrust of the torsion springs 79*a* and 79*b*. This engagement is held by means of the thrust of the springs 79*a* and 79*b*, and thus the cover 42 is kept closed. The closed cover 42 may be opened through the operation as described before, by re-insertion of the key 67 accompanied by rotation of the latch members 72*a* and 72*b*.

As hitherto been discussed, according to the present invention, only when the correct key is inserted into the key-operated lock disposed in the lockable cap from below the lock, operation of the latch releasing member and thus disengagement of the cover from the latch member is enabled to allow the opening for receiving the lock operation means to be exposed for setting or opening operation of the locking device using the lock operation means. Therefore a lock security system is established easily by simply attaching such a lockable cap with respect to a locking device of various types and manufacturers.

According to the present invention, upon disengaging the openable cover from the latch member, the elastic member assists in opening the cover to a predetermined extent with its elastic thrust, so that undesired re-closing of the cover by the return of the latch member may be avoided. Further, by orienting the key insertion port of the key-operated lock downward, and by providing in the key insertion port a shutter that opens upon insertion of the key, intrusion of water droplets and dusts into the interior of the key-operated lock may be prevented.

In addition, the use of the lock of a key-insertion type containing pins or a corrugated plate reduces the entire thickness of the lockable cap, thereby minimizing the height of the lockable cap projecting from the door surface and improving appearance. Further, when the openable cover is closed to cover the opening for receiving the lock operation means, the elastic member acts as an excellent seal at the opening.

Although the present invention has been described with reference to the preferred embodiment, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A lockable cap comprising:

a base having an opening penetrating through said base, an openable cover pivotally mounted on said base for releasably covering said opening, an elastic member for elastically thrusting said cover in an opening direction for exposing said opening, a latch member for retaining said cover in a closed position with respect to said base against elastic thrust applied by said elastic member, a key-operated lock having in-line tumblers disposed in said base, a key for setting and opening said key-operated lock by moving said key linearly, and a latch releasing member attached to said key-operated lock and advanced with said key to press said latch member in a direction of insertion of said key for releasing said latch member to open said cover when said key is inserted into said lock to open.

2. The lockable cap of claim 1 wherein said elastic member is a seal member attached to said openable cover and closing said opening in an air-tight manner when said cover is in the closed position.

3. The lockable cap of claim 1 wherein said key-operated lock has a key insertion port oriented downward.

4. The lockable cap of claim 3 wherein said key operated lock is a lock with in-line tumblers and said key is moved linearly.

5. The lockable cap of claim 3 further comprising a shutter disposed in said key insertion port.

6. A lockable cap comprising: a base having an opening penetrating through said base, an openable cover pivotally mounted on said base for releasably covering said opening, an elastic member for elastically thrusting said cover in an opening direction for exposing said opening, a latch member for retaining said cover in a closed position with respect to said base against elastic thrust applied by said elastic member, a key-operated lock disposed in said base, a key for setting and opening said key-operated lock, and a latch releasing member attached to said key-operated lock and advanced with said key to press said latch member in a direction of insertion of said key for releasing said latch member to open said cover when said key is inserted into said lock to open, wherein said key-operated lock is a lock of a key-insertion type containing pins or a lock of a key-insertion type containing a corrugated plate.

* * * * *